US008332998B2

(12) United States Patent
Kobayashi

(10) Patent No.: US 8,332,998 B2
(45) Date of Patent: Dec. 18, 2012

(54) SHOT-PEENING PROCESS

(75) Inventor: Yuji Kobayashi, Toyokawa (JP)

(73) Assignee: Sintokogio, Ltd., Aichi Ken (JP)

( * ) Notice: Subject to any disclaimer, the term of this patent is extended or adjusted under 35 U.S.C. 154(b) by 788 days.

(21) Appl. No.: 11/990,741

(22) PCT Filed: Aug. 25, 2006

(86) PCT No.: PCT/JP2006/316705

§ 371 (c)(1),
(2), (4) Date: Feb. 21, 2008

(87) PCT Pub. No.: WO2007/023936

PCT Pub. Date: Mar. 1, 2007

(65) Prior Publication Data

US 2009/0100658 A1 Apr. 23, 2009

(30) Foreign Application Priority Data

Aug. 25, 2005 (JP) ..... 2005-243718

(51) Int. Cl.
*B24C 1/10* (2006.01)

(52) U.S. Cl. ..... 29/90.7; 148/95; 148/219; 72/53

(58) Field of Classification Search ..... 29/90.7; 148/219, 95, 212, 228; 72/53
See application file for complete search history.

(56) References Cited

U.S. PATENT DOCUMENTS

| | | | | |
|---|---|---|---|---|
| 5,205,145 | A * | 4/1993 | Ishino et al. | 72/53 |
| 5,816,088 | A * | 10/1998 | Yamada et al. | 72/53 |
| 6,038,900 | A * | 3/2000 | Miyasaka | 72/53 |
| 6,658,907 | B2 * | 12/2003 | Inoue et al. | 72/53 |
| 6,790,294 | B1 * | 9/2004 | Ishida et al. | 148/212 |
| 7,763,123 | B2 * | 7/2010 | Suda et al. | 148/318 |
| 2009/0317286 | A1 * | 12/2009 | Nishi | 420/440 |

FOREIGN PATENT DOCUMENTS

| | | |
|---|---|---|
| JP | 4-201128 | 7/1992 |
| JP | 4-269166 | 9/1992 |
| JP | 10-310823 | 11/1998 |

* cited by examiner

*Primary Examiner* — Derris Banks
*Assistant Examiner* — Kaying Kue
(74) *Attorney, Agent, or Firm* — Finnegan, Henderson, Farabow, Garrett & Dunner, L.L.P.

(57) ABSTRACT

A method of shot peening in which with respect to a carburized and quenched metal part, only its surface abnormal layer detrimental to the fatigue strength thereof is scraped without scraping of the martensitic structure underlying the surface abnormal layer, namely, in which the fatigue strength can be rendered stable and enhanced without surface cracking. As bombardment shot, use is made of a shot with hardness higher than that (first hardness) of the surface abnormal layer occurring at a surface layer portion of metal part prior to shot peening but lower than that (second hardness) of the martensitic structure.

8 Claims, 2 Drawing Sheets

SHOT-PEENING PROCESS

FIELD OF THE INVENTION

This invention relates to a shot-peening process, in particular to one to improve the fatigue strength of a metal part that has been treated by a carburization and quenching process.

BACKGROUND OF THE INVENTION

Applying a shot-peening process to a metal part that has been treated by a carburization and quenching process is well known as providing a compressive residual stress near its surface by continuously projecting small spheres, namely, shot.

By observing a cross section of a section near a surface of the metal part that has been treated by the carburization and quenching process, in particular to a gas carburization and quenching process, but before the shot-peening process is applied to it, one can see that the outermost layer is an oxidized one about 5 μm thick, immediately under it is an intergranular oxidized layer 15 μm thick, and under it is a martensitic structure. Both the oxidized layer and the intergranular oxidized layer are below referred to as an abnormal layer on the surface or an imperfect hardening layer. It is believed that they harm the fatigue strength of a product.

Therefore, to improve the fatigue strength, such a shot-peening process is applied to the metal part to ablate the abnormal layer by the collisions of the shot. In a conventional shot-peening process applied to a metal part that has such an abnormal layer on the surface, shot that has a hardness that is greater than that of the surface of the metal part is employed so as to ablate the abnormal layer on the surface of it.

The applicant assessed the Hv hardness of such a metal part from its section. In particular, it was treated by the gas carburization and quenching process, but before the shot-peening process was applied to it. Thus, it found that, regarding the Hv hardness, the oxidized layer as the outermost layer has one of about 300 and the intergranular oxidized layer has one of about 430, although one area of the martensitic structure has one of about 850 or more.

However, there is commercially-available shot that has a Hv hardness of 1000 or more. Thus it is greater than that of the martensitic structure of the metal part.

Therefore, under the condition where the hardness of the shot to be used is greater than that of the surface of the metal part, not only ablating the abnormal layer on the surface, but also even a sound martensitic structure, which is in the state wherein the elements, e.g., Mn and Cr, that improve the hardening, do not move to the grain boundary, can be undesirably ablated. Or, a crack may be generated on the surface of a sound martensitic structure. Thus there is a possibility that the fatigue strength in the metal part will decrease.

Accordingly, it is desirable to provide a shot-peening process that can ablate only the abnormal layer on the surface, without undesirably ablating, or cracking, the martensitic structure, and thus to stabilize, and to further improve the fatigue strength of, the metal part.

SUMMARY OF THE INVENTION

This invention provides a shot-peening process for projecting shot to a metal part that that has been treated by a carburization and quenching process or a nitro carburizing and quenching process. This process uses shot to be projected that has a hardness that is more than that of an abnormal layer that is formed on a surface of the metal part before the shot-peening process, but lower than that of a martensitic structure that is located immediately under the abnormal layer.

As used herein, the term "an abnormal layer that is formed on a surface of a metal part" includes an oxidized layer and an intergranular oxidized layer.

Preferably, the shot has a Hv hardness that is within the range of 430 and 850, since typical Hv hardnesses of an intergranular oxidized layer is about 430, and of a portion of a martensitic structure is about 850 or more.

For example, the desirable Hv harness of the shot may be greater than 430 and less than 850, to ensure that the shot-peening process ablates only the abnormal layer on the surface without undesirably ablating or cracking the martensitic structure, if one considers variations in an Hv hardness of the shot due to its measurement.

The shot that can be used for the process of the present invention includes, e.g., steel balls, ceramic spheres, zirconium spheres, etc.

Preferably, the mean particle diameter of the shot is from 20 μm or more to less than 3 mm. The reason for this is that the compressive residual stress, which is one of the effects of the shot-peening process, may be insufficient with shot whose mean particle diameter is less than 20 μm. Further, if the mean particle diameter of the shot is greater than 3 mm, the excessive weight of the particles causes a problem that involves deformations or cracks on the surface of the metal part.

The present invention also provides a shot-peening process for projecting shot to a metal part to ablate its abnormal layer. The metal part to be shot-peened has been treated by a carburization and quenching process that produces said abnormal layer that is formed on a surface of the metal part and that produces a martensitic structure that is located immediately under the abnormal layer. This process comprises the steps of experimentally or empirically determining a first hardness, which is a hardness of the abnormal layer on the surface of the metal part, and a second hardness, which is a hardness of the martensitic structure; selecting the shot to be projected such that its hardness is in the range between the first hardness and the second hardness; and projecting the selected shot to the metal part.

EMBODIMENTS

In the illustrative embodiment of the shot-peening process of the present invention, described below, each metal part to be used is a carburizing steel material (it is known as SCM420H, chromium molybdenum steel prescribed in JIS G 4052) that is configured as a gearwheel. It has been treated by a gas carburization and quenching process. Such a component is just an example of a metal part that has been treated by a carburization and quenching process. Thus it is not intended to limit the present invention.

To investigate the surface layer and the cross-sectional structure that are affected by the gas carburization and quenching process, a specimen was prepared from one metal part, and observed as below. First, the one metal part was sliced to form a specimen that then was etched with a 3% nital liquid. The etched specimen was then embedded in a thermoplastic resin and was ground. By observing the ground specimen with an optical microscope, observed as in FIG. 1 were an oxidized layer (area A), which presents a black etched appearance at the surface, an intergranular oxidized layer (area B) that is generated immediately under the oxidized layer, and a martensite layer (area C). It shows the observation of the sectional structures at a magnifying power of 400.

The hardnesses near the surfaces that were observed were experimentally measured with a Vickers sclerometer when the same load was applied. Its results are shown in Table 1.

TABLE 1

| | Intergranular Oxidized layer | Martensite Layer |
|---|---|---|
| Hardness (Hv) | about 430 | about 856 |

Figure 2:
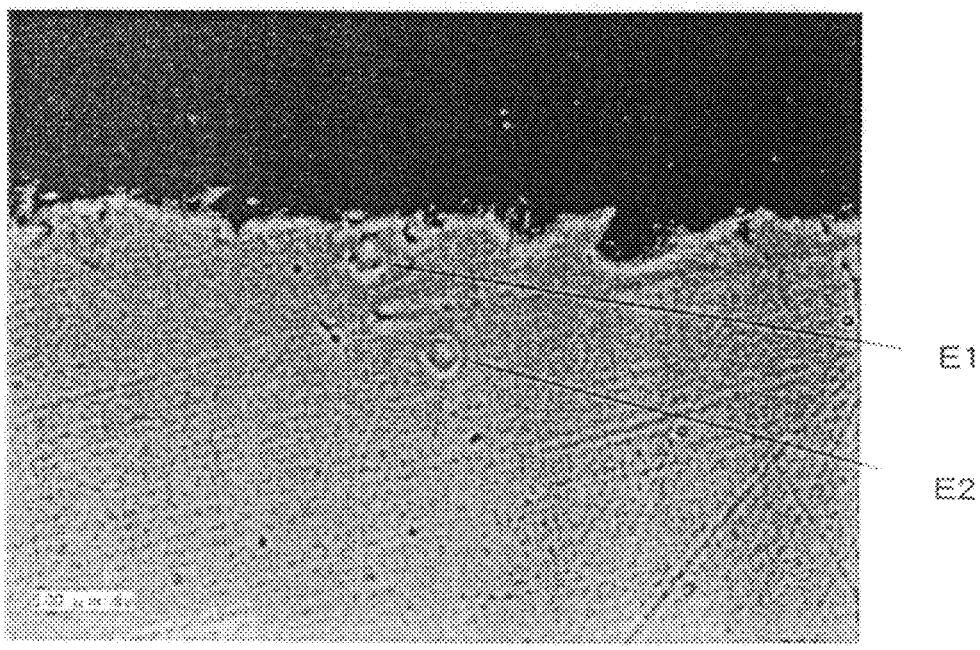
FIG. 2 is a cross-sectional observation for impressions caused by a measurement of a hardness.

FIG. 2 also shows the observation of the cross-sectional structures of the layers with a magnifying power of 3,000. In FIG. 2, E1 and E2 are impressions of a Vickers indenter when the Vickers hardness at the surface of the intergranular oxidized layer and the martensite layer are measured. It should be appreciated that the sizes of the impressions demonstrate that the intergranular oxidized layer has a low hardness.

A metal part whose martensite layer has a Hv hardness of about 856 has been treated by the shot-peening process using shot (steel balls) that had a Hv hardness of 800, i.e., that is lower than that of the metal part.

Figure 3:
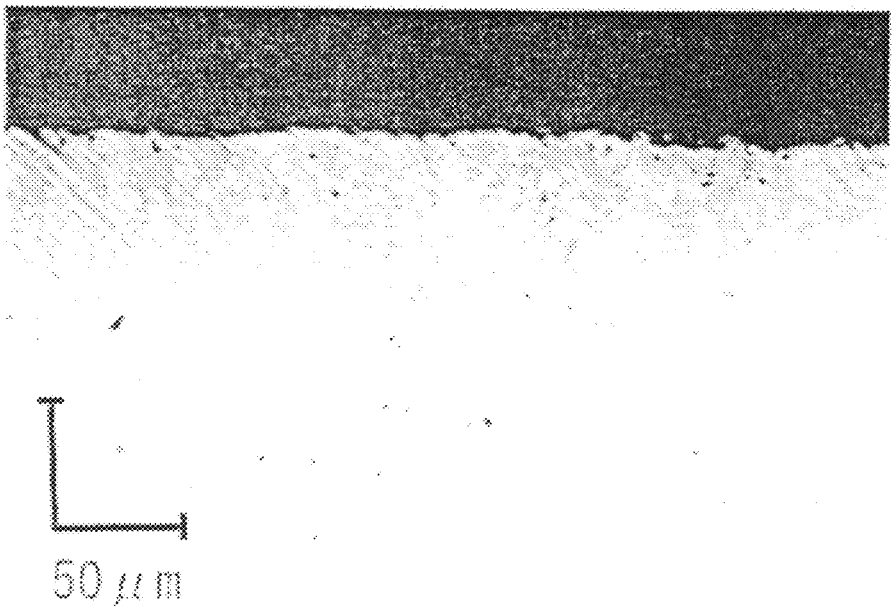
FIG. 3 is a cross-sectional observation of a piece of metal that has been treated by a shot-peening process using shot having a low hardness.

In this embodiment, the shot-peening machine employed was an air shot-peening machine with direct pressure. Its peening conditions were 0.3 MPa, and 300% in shot-peening coverage. FIG. 3 is a cross-sectional observation for this embodiment, with a magnifying power of 450. As will be appreciated from FIG. 3, the oxidation abnormality layer has been removed to the extent that the martensite layer is not exposed.

Figure 4:
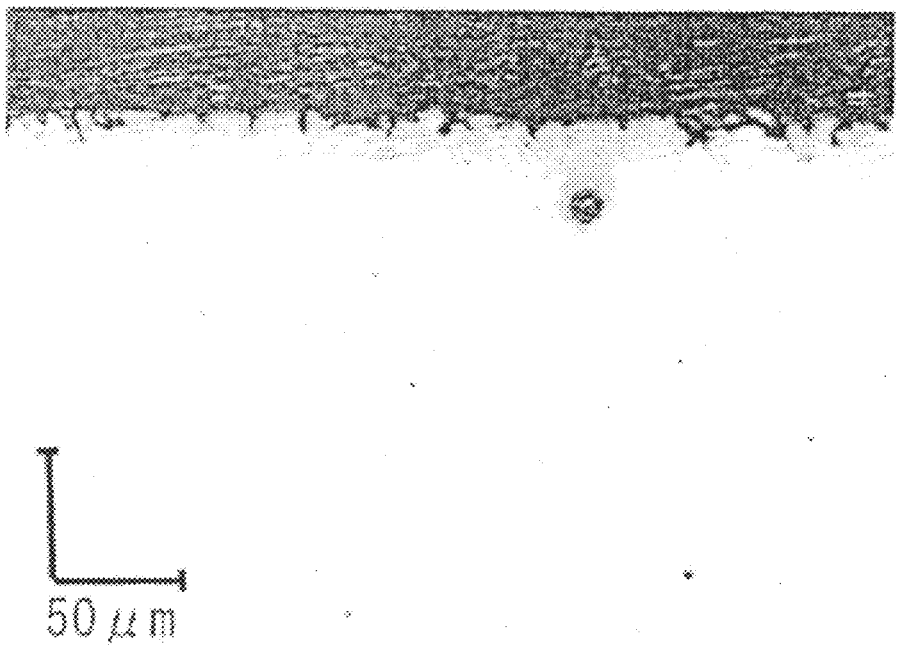
FIG. 4 is a cross-sectional observation of a piece of metal that has been treated by the shot-peening process, and using shot having a high hardness.

To compare the present invention, a comparative shot-peening process was performed by using shot that has a high hardness, i.e., a Hv hardness of 1,000, which is also called a high-speed steel, using the forgoing shot-peening machine under the above shot-peening conditions. FIG. 4 shows the view of the sectional structures in this comparative example with a magnifying power of 450. FIG. 4 indicates that the oxidation abnormality layer is fully ablated, while the martensite layer immediately below it is also ablated. Thus it is expected that an undesirable effect, e.g., cracking, may be caused thereon. Thus, if shot having an unnecessary hardness is used, the martensitic structure is harmed.

In contrast, the shot-peening process of the present invention can be performed without any undesirable effect, e.g., cracking, on the martensitic structure, by employing shot that has a hardness within the range between that (the first hardness) of the abnormal layer on the surface and that (the second hardness, where the second hardness is greater than the first hardness) of the martensitic structure.

Figure 1:
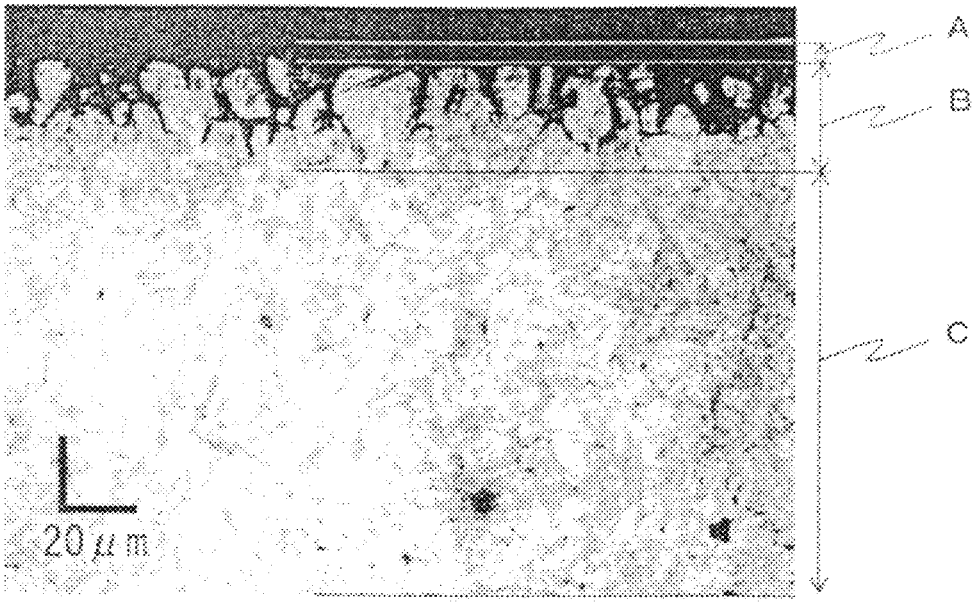
FIG. 1 shows a cross-sectional observation of a gas carburizing product.

In the embodiments of the present invention that refer to FIGS. 1-3, measurements based on experiments were carried out with the Vickers sclerometer to obtain values for the first hardness and the second hardness. However, the process of the present invention is not limited to such a measurement based on experiments. For instance, if previously acquired data of the first hardness and the second hardness based on any experiment or experience is available, the hardness of the shot may be selected based on such data.

Note that the forgoing conditions for a projection and the projection machine are just described as an exemplification, and are not intended to limit the present invention. For instance, although a preferable shot-peening coverage is 300% or more, an acceptable coverage is 100% or more. The velocity of the shot that is projected may be set at, e.g., 50 m/s or more. Although the projection device includes any device that can project the shot by means of an impeller or a wheel, or that can project the shot from a nozzle by means of an air injection, it is not limited to a specific device.

The shot-peening process of the present invention can be applied to a metal part, such as a mechanical part that is made of steel alloys for structural use in machines, as, e.g., SCr or SCM. The metal part has been treated by a carburization and quenching process, such as a gas carburization, heating, and quenching process using a RX gas, or a nitrocarburizing and quenching process. Such a metal part includes, but is not limited to, a gearwheel for an automotive transmission.

The invention claimed is:

1. A method of improving the fatigue resistance of a ferrous metal part, comprising the steps of:

carburizing or nitrocarburizing the outer surface of said metal part;

subsequently quenching the carburized or nitrocarburized metal part to form a layered structure with an outer layer comprised of an oxidized layer and an intergranular oxidized layer, and a second layer beneath said outer layer, said second layer consisting essentially of martensite;

determining the hardness said outer layer and said second layer;

selecting a shot material for shot peening said metal part such that the hardness of said shot material is greater than the hardness of said outer layer and less than the hardness of said second layer; and impinging shot of the selected shot material onto the surface of said metal part.

2. The method of claim 1 wherein the step of impinging shot of the selected shot material on said metal part removes said outer layer.

3. The method of claim 1 wherein the step of impinging shot of the selected shot material on said metal part induces residual compressive stress in said second layer.

4. The method of claim 1 including the step of inducing compressive stress in said second layer by impinging shot on said second layer having a mean particle diameter greater than 20 μm.

5. The method of claim 1 wherein the step of impinging shot of the selected shot material onto the surface of said metal part is such that cracking of said second layer is substantially precluded.

6. The method of claim 1 including the step of reducing cracking in said second layer by impinging shot on said second layer having a mean particle less than 3 mm.

7. The method of claim 1 wherein the shot impinged on said metal part has a mean particle diameter in the range of from 20 μm to 3 mm.

8. A method of improving the fatigue resistance of a ferrous metal part, comprising the steps of:

carburizing or nitrocarburizing the outer surface of said metal part;

subsequently quenching the carburized or nitrocarburized metal part to form a layered structure with an outer layer comprised of an oxidized layer and an intergranular oxidized layer, and a second layer beneath said outer layer, said second layer consisting essentially of martensite;

determining the hardness said outer layer and said second layer;

selecting a shot material for shot peening said metal part such that the hardness of said shot material is greater than the hardness of said outer layer and less than the hardness of said second layer; and impinging shot of the selected shot material onto the surface of said metal part to remove said outer layer and induce residual compressive stress in said second layer.

* * * * *